United States Patent [19]

Chang et al.

[11] Patent Number: 4,792,728

[45] Date of Patent: Dec. 20, 1988

[54] CATHODOLUMINESCENT GARNET LAMP

[75] Inventors: Ifay F. Chang, Chappaqua; Ronald I. Feigenblatt, Dobbs Ferry; Webster E. Howard, Yorktown Heights, all of N.Y.; Eugene I. Gordon, Convent Station, N.J.

[73] Assignee: International Business Machines Corporation, Armonk, N.Y.

[21] Appl. No.: 743,190

[22] Filed: Jun. 10, 1985

[51] Int. Cl.[4] ..... H01J 1/62

[52] U.S. Cl. ..... 315/169.3; 313/486; 313/495; 252/301.4 R

[58] Field of Search ..... 313/495–497, 313/44, 486, 368, 367, 370; 252/301.4 R; 315/169.3; 357/17

[56] References Cited

U.S. PATENT DOCUMENTS 4,093,890 6/1978 Verriet et al. ..... 313/486
4,100,454 7/1978 Hase et al. ..... 252/301.4 R
4,152,623 5/1979 Kagami et al. ..... 313/495
4,352,043 9/1982 Rigden ..... 313/293

OTHER PUBLICATIONS

Van Tol et al., A High Luminance High Resolution Cathode-Ray Tube for Special Purposes, 3-1983, pp. 193–197.

*Primary Examiner*—David K. Moore
*Assistant Examiner*—Michael Razavi
*Attorney, Agent, or Firm*—Pollock, Vande Sande & Priddy

[57] ABSTRACT

A cathodoluminescent lamp in the form of a vacuum diode or triode uses a self-supporting YAG crystal as the light emitter. The crystal shape can be selected (spherical, slab, bar) for desired effect and light trapping is turned to advantage by selectively coating the crystal surface to provide for preferential light emission.

16 Claims, 3 Drawing Sheets

CATHODOLUMINESCENT GARNET LAMP

DESCRIPTION

TECHNICAL FIELD

The present invention relates to projection lamps, and more particularly, an intense light source comprising an electron (or photon) excited self-supporting garnet crystal.

BACKGROUND ART

In the field of projection displays, a high intensity lamp is required which emits highly luminous fluxes from small areas. A widely used example is a xenon arc lamp which may emit 2000 lumens from a few square millimeters with an efficiency of 10 lumens/watt. The xenon arc lamp suffers from lack of high efficiency, a requirement for a high current, low voltage power supply which is expensive, and a lamp life which may not extend beyond 1000 hours.

Alternatives to the xenon arc lamp are conventional tungsten or gas discharge lamps. These lamps suffer similar problems in achieving high brightness (and efficiency) along with high output, yet are relatively small in dimension and provide close to point source light.

Van Tol et al in "A High Luminance High-Resolution Cathode-Ray Tube for Special Purposes" appearing in the *IEEE Transactions on Electron Devices,* Vol. ED-30, No. 3, March 1983 at pages 193–197 describes a light source consisting of a cathodoluminescent screen consisting of rare-earth doped yttrium-aluminum garnet (YAG) epitaxially grown on commercially available YAG substrates. Van Tol et al report that the arrangement provides relatively high efficiency, good brightness, and does not require a high current supply.

On the other hand, the epitaxial nature of the layer has a profound influence on the optical characteristics; in particular light trapping in the epitaxial layer severely reduces the useful emission. For example, the authors report that any light emitted at angles with the normal to the screen surface that are larger than the critical value will not even leave the screen until the light has travelled sideways to the edges of th screen, and in that event even if the light does leave the screen it may not leave it so as to be usefully directed.

It is thus one object of the invention to provide a high intensity point-like light source having particular utility for projection displays, which does not require high current supply, exhibits good brightness and efficiency, and is not limited by the light trapping effects reported by van Tol et al.

All embodiments of the invention described hereinafter use a self-supporting garnet crystal, preferably yttrium-aluminum garnet which is cerium doped, or activated, as the active light source. Nevertheless, it will be apparent that doping other than cerium could also be used. Various embodiments of the invention provide for the crystal in the form of a sphere, a rod, or a prismatic shape of rectangular or circular cross-section. Advantageously, the YAG crystal is in intimate contact with a heat sink. For certain embodiments of the invention, light trapping is advantageously employed by providing a metallic reflecting coating over a majorirty of the exposed surface of the crystal so that light is preferentially emitted through a selected area or region.

The intense luminescence of the YAG crystal can be achieved by electron excitation (as is the case in all the embodiments specifically described) although photo excitation is also contemplated.

The use of a self-supporting crystal eliminates the epitaxial growth complexity of the prior art and provides the lamp designer with additional freedom to select the geometry or the light emitter to achieve a desired effect. Light trapping in the crystal is used to advantage by selectively coating the crystal to provide for a preferential region (as well a direction) of light emission.

BRIEF DESCRIPTION OF THE DRAWINGS

The present invention will now be further described in the following portions of the specification which contain a description of several preferred embodiments, in connection with the attached drawings in which like reference characters identify identical apparatus and in which.

DETAILED DESCRIPTION OF PREFERRED EMBODIMENTS

Figure 1:
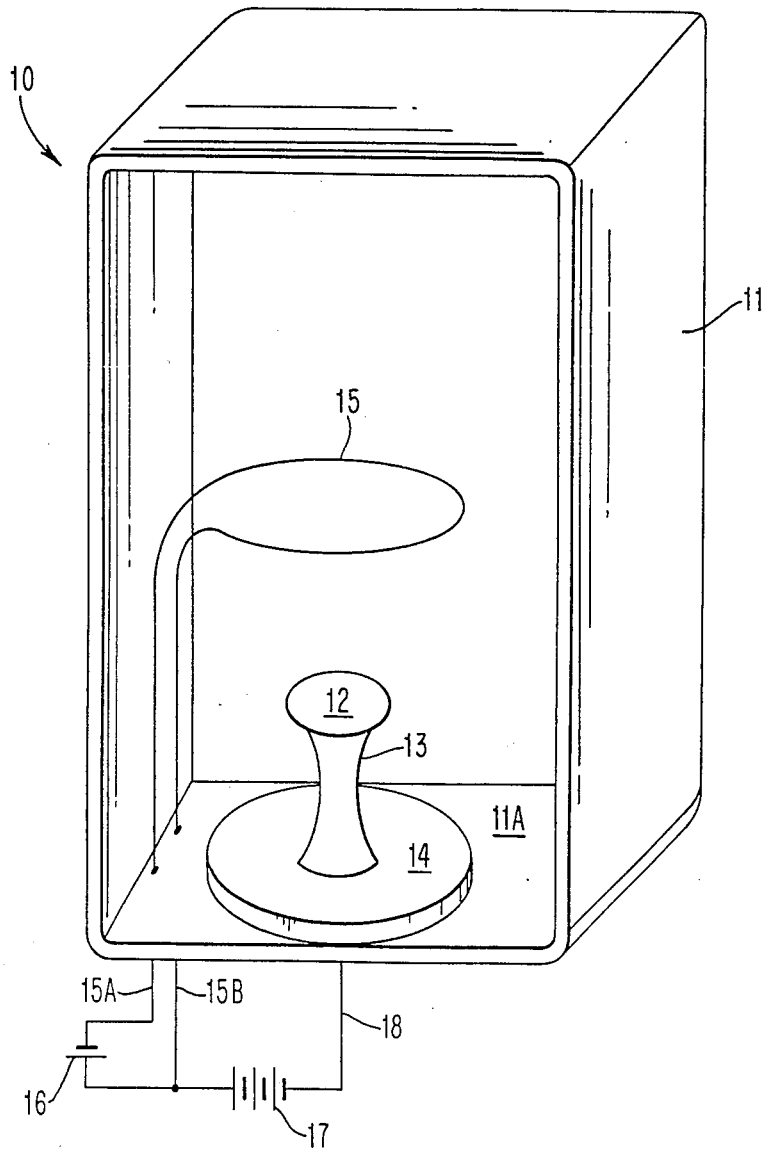
FIGS. 1, 2, 3 and 4 illustrate two different embodiments.

FIG. 1 shows one embodiment of a high intensity lamp 10 in accordance with the invention. The lamp 10 includes an evacuated chamber formed by walls 11 which may be of glass, or partly glass. The light emitter 12 comprises a spherical polished ball machined from a single crystal of cerium doped YAG, with a diameter on the order of a millimeter. The ball 12 is bonded to a post 13 in intimate contact with a heat sink 14, also serving the purpose of an anode in a vacuum diode. An emitting filament 15 having the form of a ring is placed nearby emitter 12. Coupled through one wall 11*a* is a high voltage conductor 18 which is electrically connected to the heat sink 14. Filament conductors 15*a* and 15*b* are electrically connected to the filament 15. Voltage sources 16 and 17 are provided, a low voltage source 16 providing energy for the filament current, and a high voltage source 17 providing the anode voltage. Electron bombardment from the filament 15 produces an intense luminance of the ball 12. Since the filament is a line source, the crystal ball 12 is excited from many directions. Furthermore, there is no preferential excitation point on the surface of the crystal 12 and as a result a large proportion of the available surface area is excited. Preferably the interface between the ball 12 and the post 13 is reflecting (metallic). As a result, light which might otherwise be trapped in the garnet 12 is emitted radially so that the spherical geometry overcomes light trapping.

A lamp such as is shown in FIG. 1 could produce 50 lumens per watt, or 1000 lumens, for example, from a 20 watt lamp. Such geometry provides a much more convenient "point source" for a projection optical system than the xenon arc lamp and a much brighter point source than a tungsten lamp.

The power output for the lamp of FIG. 1, for a given size of the YAG crystal is ultimately limited by thermal conductivity, since above 300° C. there is a quenching of the luminance.

Figure 2:
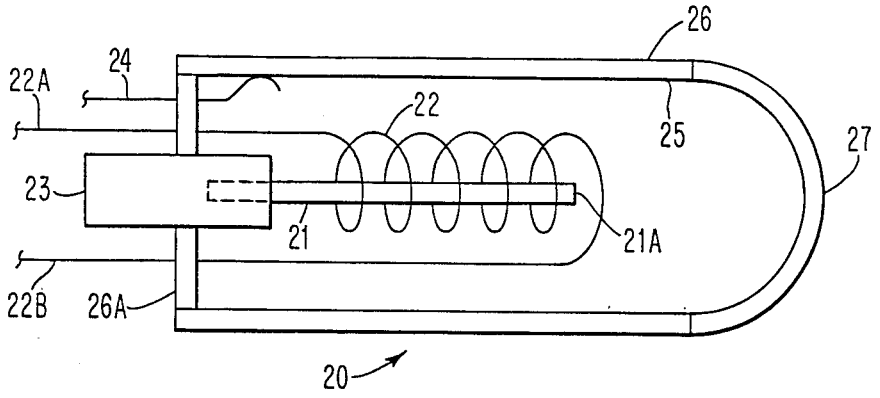
Figure 3:
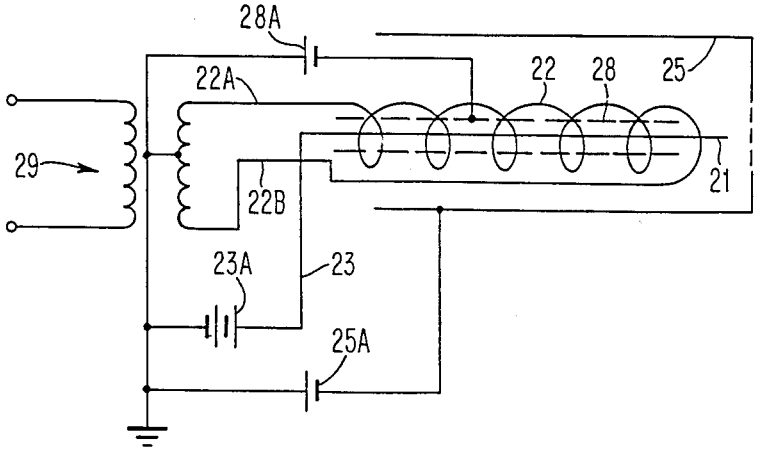
Figure 4:
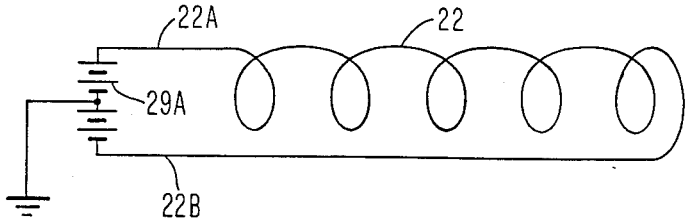

In a second embodiment of the invention shown in FIGS. 2 through 4, a cathodoluminescent (and/or photoluminescent) garnet cylindrical rod 21 is held in a thermal conductive base holder 23 which can be copper or other conductive material. A conductive foil such as gold or a conductive solder such as gallium or tin can be used to wrap the garnet bar 21 and make contact with the holder 23 in the dotted region. The base holder 23 is connected to a high voltage power supply through a lead which is isolated from other leads on a glass or ceramic disc 26*a*. A filament coil 22 surrounds the garnet rod 21 and is supported through a pair of metal leads 22*a* and 22*b* which are connected to a filament power supply (not illustrated). The leads or the power supply are biased negatively relative to the garnet rod 21. The garnet rod 21, serving as an anode, is coated with a thin conducting film such as gold, silver or aluminum all around except at the end 21*a*, where light can exit. The lamp 20 operates as a vacuum diode much in the manner as the lamp 10 of FIG. 1. The interior of the lamp housing which is defined by cylindrical walls 26 (which may be glass or ceramic) is coated with a conductive material 25 such as metal or aquadaq, except at the exit area 27 which is left transparent to allow light transmission. The exit area 27 can be molded or made to have a condensing lens property without any substantial cost. The interior coating 25 on the inner surface of the walls 26 is biased at the filament potential, or slightly below, via the lead 24, to facilitate repelling stray electrons from the filament back to excite the garnet 21. The filament 22 can be tungsten wire or coated with a thermionic oxide material to increase emission efficiency. To facilitate or regulate control of light output, an optional grid 28 (seen in FIG. 3 but not shown in FIG. 2), concentric with the filament coil 22 is modulated with a grid potentialnnear or below the filament potential to control the amount of electrons reaching the anode. In order to control this modulation, a photo-detector (not illustrated) can be placed exterior to the lamp or mounted interior of the lamp to generate the modulation controlling signal in a negative feedback control loop. The garnet itself (for example cerium activated YAG) can take high power excitation so the anode voltage can vary from 10's of volts to 10's of kilovolts. Since the filament is agains a line source, the garnet 21 is excited from many directions. The power is only limited by the temperature quenching of the garnet, around 580° K. Conductively or metallically coating the majority of the surface of the garnet rod 21 (except in the region of the exit face 21*a*) employs light trapping to advantage, so that all the light generated can propagate down and out of the exit window 21*a*. The window size is defined by the dimension of the rod an varies from a fraction of a millimeter to crystal boule size. Minimizing absorption loss in the garnet 21 allows achieving an optimum of about 10% power efficiency. Since the lamp volume and mass is small, and the anode holder 23 can be made as massive as required to conduct heat away, heat removal should not be unacceptably troublesome. Conductive and radiative cooling through the lamp base should be adequate to respect the 580° K. boundary condition.

FIG. 3 shows a filament 22 supplied by AC excitation through a transformer 29. The battery 28*a* is illustrative of the potential difference between the grid 28 and the filament 22, although as mentioned above, in other embodiments this potential is variable so as to control light output. The high voltage or anode supply is represented by the DC supply 23*a*. The interior coating 25 is maintained at a desired potential by the supply 25*a*.

FIG. 4 is a variation of FIG. 3 in which the filament supply is DC (through the DC supply 29*a*), rather than AC as in FIG. 3. FIG. 4 shows only the filament 22, all other electrical components can be as illustrated in FIG. 3 or as described above.

Figure 5:
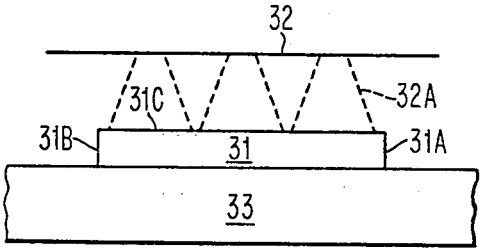
FIGS. 5 and 6 show, schematically, portions of a third embodiment.
Figure 6:
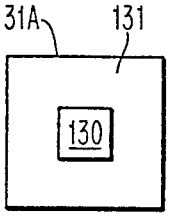

FIG. 5 is a variation on the lamp of FIGS. 1 and 2. In FIG. 5 a single garnet crystal 31 is formed in the shape of a rectangular bar or slab which is bonded to a copper block 33 or other suitable heat sink to provide thermal conduction. A filament wire 32 (or several) is stretched in parallel to and above the garnet slab 31 to provide electron excitation shown by the dashed lines 32*a*. FIG. 5 does not illustrate the supply voltage arrangement nor the form of the evacuated housing. The embodiment shown in FIG. 5 can emit light from any face of the bar 31 except at the interface to the copper block 33. Light may be preferentially emitted by metallically coating those faces of the garnet slab 31 through which light transmission is to be inhibited. Thus for example light could be preferentially emitted through either face 31*a*, 31*b* or even 31*c*, or any combination of the foregoing. Furthermore, the exit window need not cover the entire region of any one of the selected faces, and the coating can be arranged to inhibit or reflect light transmission from some but not all of the selected face. FIG. 6 for example is a front view of the face 31*a* of the garnet 31 of FIG. 5. As shown in FIG. 6 the garnet 31 is divided into two regions, interior region 130 which is surrounded by an exterior region 131. Light transmission through the region 131 is inhibited by metallic or reflective coating. The lack of such coating in the region 130 allows light transmission. In cases where maximum power is limited by thermal quenching, the arrangement of FIG. 5 is preferred for it does not limit heat sink capacity.

Figure 7:
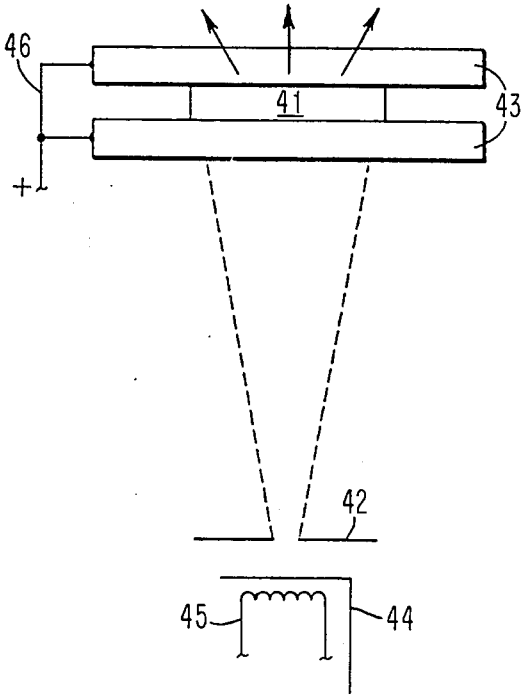
FIGS. 7 and 8 show, schematically, portions of a fourth embodiment.
Figure 8:
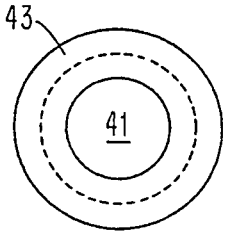

Finally, FIG. 7 is another arrangement in which the YAG crystal 41 has the form of a circular disk. The circular disk 41 is bonded between a pair of thermal (and electrical) conducting rings 43. FIG. 8 is a plan view showing the upper conducting ring 43 overlying the crystal 41. The overlap provides good thermal conduction, and light is emitted from the upper face of the crystal 41 through the aperture of the upper ring 43. Preferably the garnet 41 is coated so as to allow light transmission from the selected region of the upper face.

A cathode ray gun including a cathode 44, a filament heater 45 and a grid 42 are located in an evacuated chamber (not illustrated) to provide for electronic bombardment of the garnet 41 and resulting cathode luminescence.

Having thus described our invention, what we claim as new, and desire to secure by Letters Patent is:

1. An intense light source comprising a coating means to inhibit light transmission from regions of said crystal:

an evacuated chamber formed by one or more walls, a self-supporting garnet crystal in said evacuated chamber, a relatively massive heat sink in heat conducting relation to said crystal, excitation means located in said chamber for exciting said garnet crystal simultaneously over a substantial portion of a surface of said crystal, with electromagnetic radiation from many directions, and a light transmitting region in at least one wall of said chamber for transmitting light emitted by said garnet crystal.

2. The source of claim 1 in which said crystal is spherical.

3. The source of claim 1 in which said crystal is prismatic.

4. The source of claim 1 in which said crystal is a circular disc.

5. The source of claim 1 in which said crystal is a slab of rectangular cross-section.

6. The source of claim 1 in which said crystal is a rod of rectangular cross-section.

7. The source of claim 1 in which said crystal is YAG.

8. The source of claim 7 in which said crystal is cerium doped.

9. The source of claim 1 which includes a potential source coupled to said crystal via said heat sink.

10. The source of claim 1 in which said excitation means comprises:

a heated conductor located adjacent said crystal, a potential source for providing a potential difference between said crystal and said conductor whereby said crystal is bombarded with electrons emitted by said conductor.

11. The source of claim 10 in which said conductor is indirectly heated.

12. The source of claim 10 in which said conductor is directly heated.

13. The source of claim 1 in which said walls include a region with a condensing lens property.

14. The source of claim 1 in which at least a portion of said walls are coated to inhibit light transmission.

15. The source of claim 10 wherein said potential source is an alternating current source.

16. The source of claim 10 wherein said potential source is a direct current source.

* * * * *

UNITED STATES PATENT AND TRADEMARK OFFICE

CERTIFICATE OF CORRECTION

PATENT NO. : 4,792,728

DATED : December 20, 1988

INVENTOR(S) : Chang et al

It is certified that error appears in the above-identified patent and that said Letters Patent is hereby corrected as shown below:

Col. 1, line 44, "th" should be -the-;

line 64, "majorirty" should be -majority-.

Col. 2, line 6, "or" should be -of-;

line 9, "a" (2nd) should be -as-.

Col. 3, lines 33-34, "potentialnnear" should be -potential near-;

line 43, "agains" should be -again-;

line 45, "580° K" should be -580 K-;

line 51, "an" should be -and-;

line 59, "580° K." should be -580 K-.

Signed and Sealed this

Sixteenth Day of May, 1989

*Attest:*

*Attesting Officer*

DONALD J. QUIGG

*Commissioner of Patents and Trademarks*